United States Patent [19]

Oguma et al.

[11] Patent Number: 4,700,082

[45] Date of Patent: Oct. 13, 1987

[54] CIRCUIT BREAKER

[75] Inventors: Tomio Oguma; Hisanobu Takeda; Yasuhiro Asou, all of Aichi, Japan

[73] Assignee: Aisin Seiki Kabushiki Kaisha, Kariya, Japan

[21] Appl. No.: 860,937

[22] Filed: May 8, 1986

[51] Int. Cl.[4] ..... H01H 35/00

[52] U.S. Cl. ..... 307/116; 324/71.2; 340/602

[58] Field of Search ..... 361/87, 93, 103, 104; 307/116, 118; 340/602, 604, 638, 639, 618, 620, 627, 632; 324/71.2; 328/4

[56] References Cited

U.S. PATENT DOCUMENTS

| | | | |
|---|---|---|---|
| 2,735,754 | 2/1956 | Draonieks | 324/71.2 X |
| 3,562,731 | 2/1971 | Hsu | 340/604 |
| 3,895,264 | 7/1975 | Kirilloff | 361/93 X |
| 4,246,575 | 1/1981 | Purtell et al. | 340/605 |
| 4,263,589 | 4/1981 | Lewiner et al. | 340/638 |
| 4,556,874 | 12/1985 | Becker | 340/639 X |
| 4,618,906 | 10/1986 | Paice et al. | 361/93 X |

FOREIGN PATENT DOCUMENTS

| | | | |
|---|---|---|---|
| 2137389 | 10/1984 | United Kingdom | 340/632 |

*Primary Examiner*—A. D. Pellinen
*Assistant Examiner*—Derek S. Jennings
*Attorney, Agent, or Firm*—Sughrue, Mion, Zinn, Macpeak & Seas

[57] ABSTRACT

A circuit breaker for automatically interrupting the flow of an electric current from a power supply to a load such as a microcomputer before the load malfunctions so as to avoid an unexpected accident such as a fire. The circuit breaker includes a wire subject to erosion upon exposure to an acid atmosphere which will separate prior to the malfunction of the load to interrupt the flow of current to the load. Alternatively, the circuit breaker could include a mass of powdery material which expands upon exposure to an acid atmosphere to operate a switch to interrupt the flow of current.

4 Claims, 15 Drawing Figures

FIG. 1
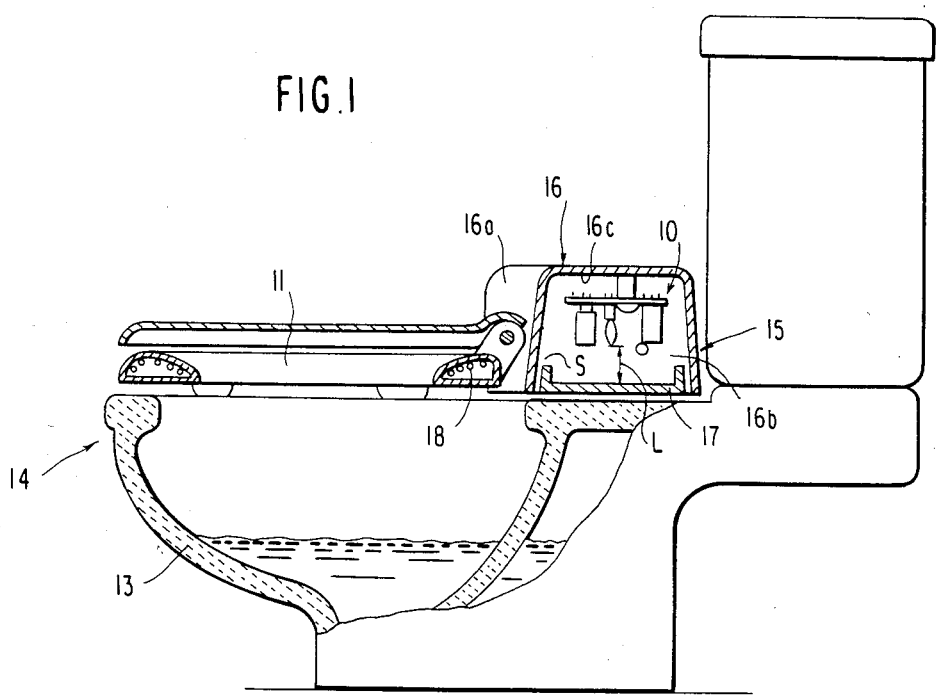
FIG. 2
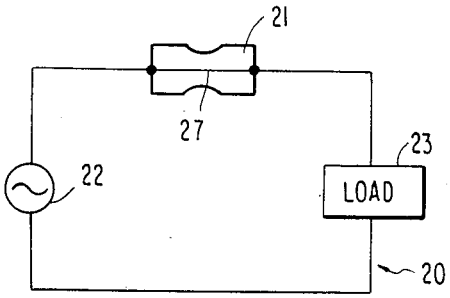
FIG. 3
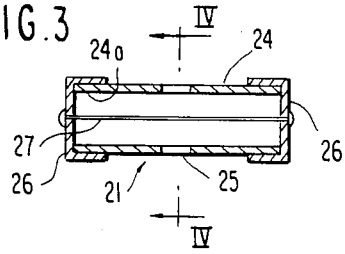
FIG. 4
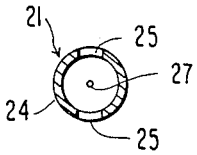
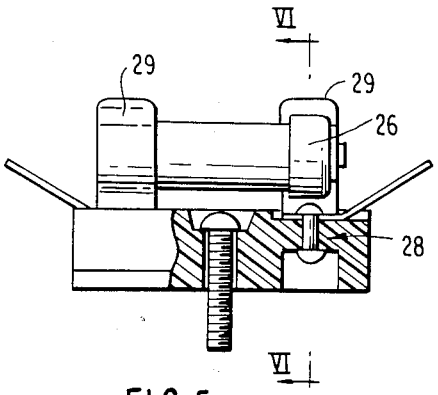
FIG. 5
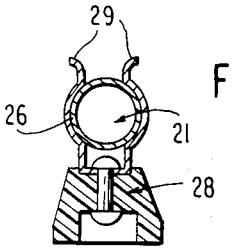
FIG. 6
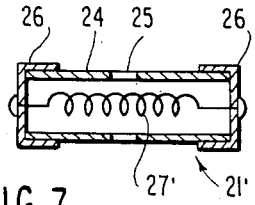
FIG. 7

CIRCUIT BREAKER

BACKGROUND OF THE INVENTION

The present invention is directed to a circuit breaker and more specifically to a circuit breaker for automatically interrupting the flow of an electric current before a load in the circuit malfunctions due to acid contained in the ambient air surrounding the circuit.

Electric circuits are widely used in various devices associated with a water supply. For example, as seen from FIG. 1, an electric circuit 10 is employed for controlling the temperature of a toilet seat 1. In detail, a toilet bowl 13 of a sanitary device 14 is provided at a rear end portion thereof with a casing 15. The casing 15 includes a main body 16 with a pair of symmetrical ribs 16*a*, 16*a* (only one of which is shown) and a base plate 17 loosely fitted within the cavity 16*b* defined by the main body 16. The seat 11 beneath which heater means 18 is provided is pivotally mounted to the ribs 16*a*, 16*a*. The circuit 10 is depended from the top wall 16*c* of the main body 16 and is positioned above the base plate 17 at a distance L therefrom.

According to this construction the circuit 10 may be protected from water which might enter the casing 15 through a gap S formed between the opening of the main body 16 and the base plate 17. However the circuit 10 is continually exposed to air containing acid from within the toilet bowl 13 which is frequently washed with acid cleaning liquid. Without protection of the circuit 10, which may include a microcomputer, from acid contained in the ambient air sooner or later the circuit 10 will malfunction due to corrosion and a fire may break out.

SUMMARY OF THE INVENTION

It is, therefore, a primary object of the present invention to provide a circuit breaker for automatically interrupting the flow of an electric current before a load of a circuit is brought into malfunction due to acid contained in the ambient air therearound.

The present invention provides a new and improved circuit breaker for automatically interrupting the flow of an electric current before the circuit malfunctions due to the presence of acid in the ambient air comprising a copper wire which is susceptible to erosion by the acid atmosphere being operatively associated with a switch so that upon breakage of the wire due to erosion thereof the circuit will be opened before any damage can occur to the load connected in the circuit.

The present invention further provides a new and improved circuit breaker for automatically interrupting the flow of an electric current in a circuit exposed to an acid atmosphere comprising a mass of metallic powder such as copper powder confined in a porous container having at least one expansible wall so that upon expansion of the copper powder mass due to contamination by the acid from the atmosphere the expandable wall will move outwardly to interrupt a circuit by means of an interposed mechanical element.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a cross sectional view of a sanitary device to which an electric circuit is applied.

FIG. 2 is a diagram for showing a circuit to which a first embodiment of a circuit breaker according to the present invention is applied.

FIG. 3 is a cross sectional view of the circuit breaker shown in FIG. 2.

FIG. 4 is a cross sectional view of the circuit breaker along line IV—IV in FIG. 3.

FIG. 5 is an elevational view, partly in section, showing the circuit breaker in the form of a fuse which is held in a holder.

FIG. 6 is a cross sectional view along line VI—VI in FIG. 5.

FIG. 7 is a cross sectional view of a second embodiment of the circuit breaker according to the present invention.

DETAILED DESCRIPTION OF THE INVENTION

Figure 8:
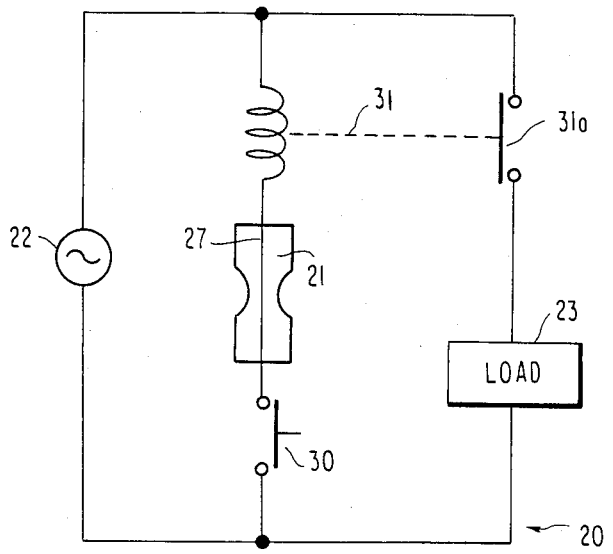
FIG. 8 is a diagram of a circuit in which a third embodiment of the circuit breaker according to the present invention is applied.

Referring now to FIGS. 2 through 6, there is illustrated an electric circuit 20 in which a fuse 21 is employed as a circuit breaker. The fuse 21, interposed between a power supply 22 and a load 23 such as a microcomputer, includes a cylindrical body 24 having a pair of radial holes 25, 25 and a pair of metal caps 26, 26 both of which are respectively mounted on opposite end poritons of the body 24. A metal wire 27 such as copper wire, susceptible to erosion, is provided in the body 24. The wire 27 in the form of a straight line is connected or welded at opposite end portions thereof to the metal caps 26, 26, respectively. For holding the fuse 21 a well known holder 28 with a pair of clip means 29, 29 is used. Each metal cap 26 is detachably held by a corresponding clip means 29. The circuit 20 is disposed in a casing (not shown) of a sanitary device (not shown) similar to the circuit 10 as shown in FIG. 1. Thus, the wire 27 is exposed to air having acid therein via the radial holes 25, 25 of the body 24. The wire 27 is so susceptible to erosion that the cross sectional area of the wire 27 is gradually reduced. During the flow of an electric current through the resulting wire 27, heat is being generated therein and the remaining reduced diameter wire 27 is melted. Accordingly the flow of an electric current from the power supply 22 to the load 23 is automatically interrupted before the load 23 malfunctions and an accident such as a fire can occur.

In the fuse 21 as shown in FIG. 7, a wire 27' is of spiral configuration. The wire 27' is continually maintained under tension in the axial direction thereof so that the wire will automatically break upon excessive decrease in cross sectional area of the wire 27' due to the advancement of erosion. Thus the flow of an electric current from the power supply 22 to the load 23 is automatically interrupted.

In FIG. 8 a switch 30, a fuse 21, and a relay 31 are connected in series between opposite terminals of a power supply 22. A normally closed contact 31*a* of the relay 31 is interposed between the power supply 22 and a load 23. Upon melting of the wire 27 in the fuse 21, the contact 31*a* is opened so that the flow of an electric current from the power supply 22 to the load 23 is automatically interrupted.

Figure 9:
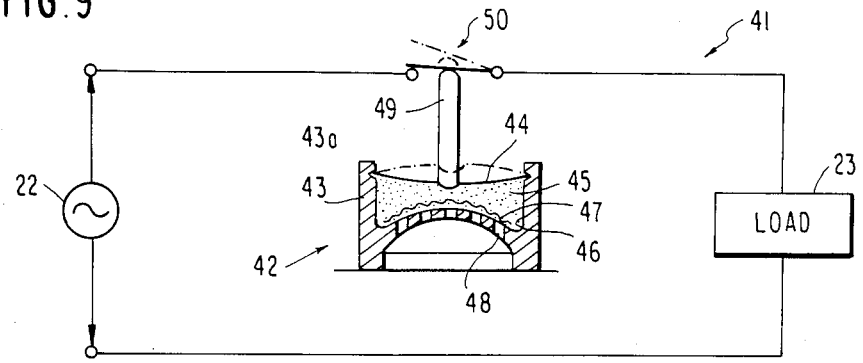
FIG. 9 is a schematic view showing a fourth embodiment of the circuit breaker according to the present invention.

In FIG. 9 a circuit 41 includes a detecting device 42 for detecting excess acid in the ambient air surrounding the circuit 41. The detecting device 42 has a casing 43, a snapaction plate 44 closing an opening 43*a* of the casing 43, and a powdery metal 45, such as powdery copper, contained in the space 46 defined between the casing 43 and the plate 44. The powdery metal 45 is subject to expansion in size upon absorption of acid therein and is in fluid communication with ambient air containing acid through a mesh 47 and a porous plate 48. In accordance with the aforementioned construction the powdery metal 45 is brought into expansion due to acid contained in the ambient air therearound. The resulting expansion of the powdery metal 45 makes the plate 44 snap into a convex condition as shown in phantom line in FIG. 9. Due to such snap action of the plate 44 a rod 49 is moved in the upward direction which results in the opening of a normally closed switch 50. Thus the flow of an electric current from a power supply 22 to a load 23 is automatically interrupted.

Figure 10:
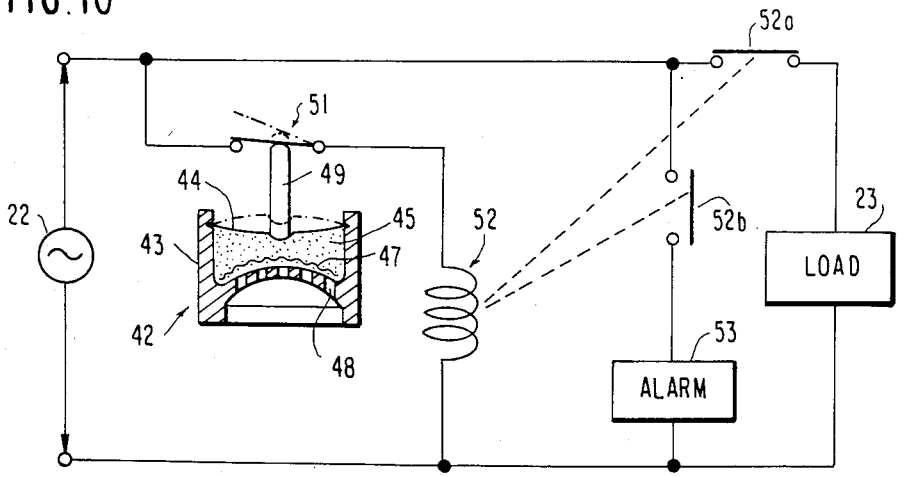
FIG. 10 is a schematic view showing a fifth embodiment of the circuit breaker according to the present invention.

In FIG. 10 a switch 51, which is opened by a rising rod 49, is interposed between a power supply 22 and a relay 52. The relay 52 includes a first contact 52*a* which is normally closed and a second contact 52*b* which is normally opened. The first contact 52*a* is interposed between the power supply 22 and a load 23 while the second contact 52*b* is interposed between the power supply 22 and an alarm device 53 such as a buzzer or a lamp. Upon opening of the switch 51 the first contact 52*a* of the relay 52 is opened with the result that the flow of an electric current from the power supply 22 to the load 23 is interrupted. Simultaneously the alarm device 53 is connected to the power supply 23 due to closure of the second contact 52*b* of the relay 52, thereby giving a signal that the load 23 has to be replaced with a new one.

Figure 11:
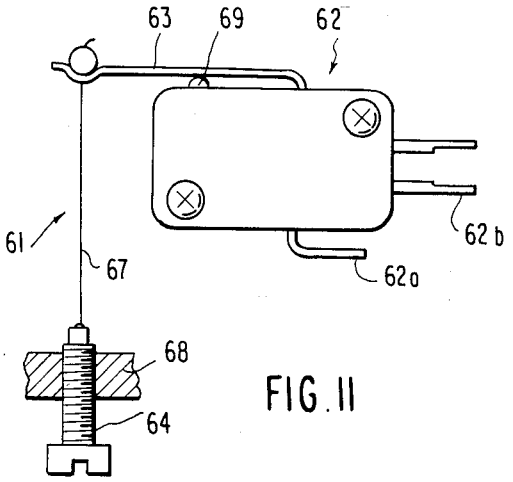
FIG. 11 is a front view of a sixth embodiment of the circuit breaker according to the present invention.
Figure 12:
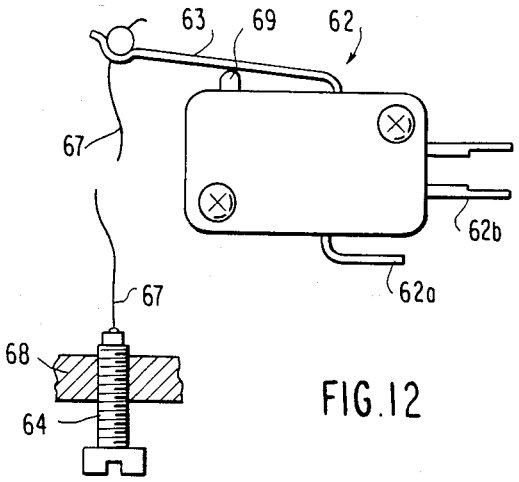
FIG. 12 is a view showing the actuation of the circuit breaker shown in FIG. 11.

A circuit breaker 61, shown in FIGS. 11 and 12, includes a micro switch 62 with a lever 63 and a wire 67 tensioned between a distal end portion of the lever 63 and a bolt 64 threadably secured to a stationary member 68. The micro switch 62 has a first terminal 62*a* and a second terminal 62*b*. The former and the latter are respectively connected to a power supply (not shown) and a load (not shown) similar to the previous embodiments. Though the micro switch 62 is closed while a rod 69 is urged in the downward direction due to counter clockwise biasing of the lever 63 by the tensioned wire 67, the micro switch 62 is brought into its open condition when the lever 63 is transferred in the clockwise direction after separation of the wire 67. Thus the flow of an electric current from the power supply to the load is automatically interrupted.

Figure 13:
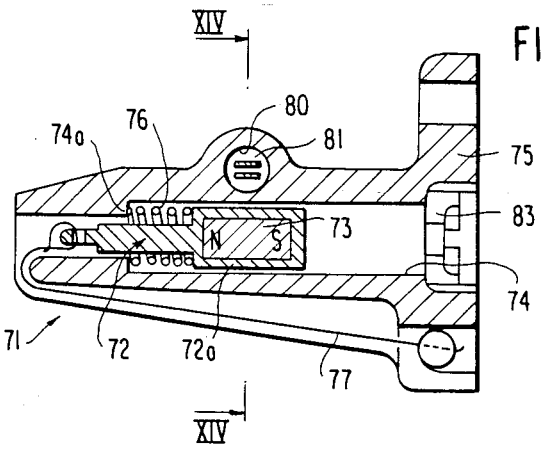
FIG. 13 is a cross sectional view of a seventh embodiment of the circuit breaker according to the present invention.
Figure 14:
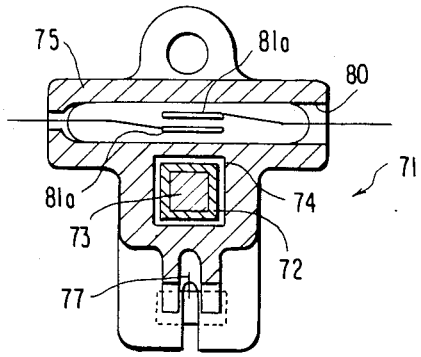
FIG. 14 is a cross sectional view along line XIV—XIV in FIG. 13.
Figure 15:
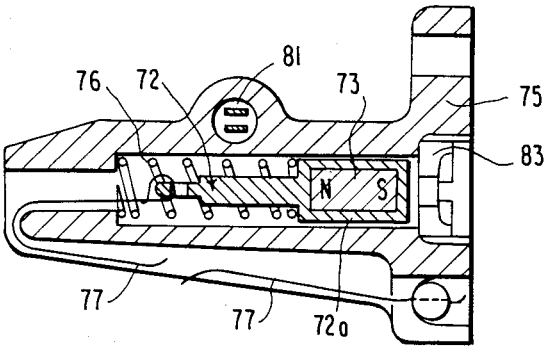
FIG. 15 is a view showing the actuation of the circuit breaker shown in FIG. 13.

A circuit breaker 71, shown in FIGS. 13 through 15, includes a slider 72 in which a magnet 73 is incorporated. The slider 72 is moveably mounted in a stepped bore 74 formed in a body 75 and is continually pulled in the leftward direction in FIG. 13 by a tensioned wire 77 against resilient force of a spring 76 which is compressed between a larger portion 72*a* of the slider 72 and a boundary wall 74*a* of the bore 74. A hole 80 is defined in the body 75 so as to be positioned above the bore 74. A reed switch 81, including a pair of overlaid contacts 81*a*, 81*a*, is inserted in the hole 80 and is closed when the contacts 81*a*, 81*a* are connected with each other due to magnetic flux from the magnet 73 which is positioned substantially below the reed switch 81. Upon breakage of the wire 77, as shown in FIG. 15, due to corrosion the spring 76 will move the magnet 73 away from the switch 81. Thus the pair of contacts 81*a*, 81*a* are brought into separation due to the inherent resiliency of the contacts so that the flow of an electric current from a power supply (not shown) to a load (not shown) is automatically interrupted. The slider 72 is stopped at the end of its stroke by a stopper 83.

While the invention has been particularly shown and described with reference to preferred embodiments thereof it will be understood by those in the art that the foregoing and other changes in form and details may be made therein without departing from the spirit and scope of the invention.

What is claimed is:

1. A circuit breaker for automatically interrupting the flow of an electric current in a circuit prior to the malfunctioning of a circuit load due to acid contained in the ambient air in contact with the circuit comprising:

a normally closed switch adapted to be interposed between a power supply and a load;

detecting means for detecting excess acid in the air around said load; and operating means for opening said switch upon actuation of said detecting means, wherein said detecting means is a fuse including a cylindrical body with at least one radial hole, a pair of metal caps mounted on opposite end portions, respectively, of said cylindrical body for electrical connection to said circuit and a wire susceptible to erosion connected between said metal caps in said cylindrical body.

2. A circuit breaker for automatically interrupting the flow of an electric current in a circuit prior to the malfunctioning of a circuit load due to acid contained in the ambient air in contact with the circuit comprising:

a normally closed switch adapted to be interposed between a power supply and a load;

detecting means for detecting excess acid in the air around said load; and operating means for opening said switch upon actuation of said detecting means, wherein said detecting means is an expandable powdery metal which expands upon excessive exposure to acid and said operating means is interposed between said metal and said normally closed switch for opening said normally closed switch in response to expansion of said powdery metal.

3. A circuit breaker for automatically interrupting the flow of an electric current in a circuit prior to the malfunctioning of a circuit load due to acid contained in the ambient air in contact with the circuit comprising:

a normally closed switch adapted to be interposed between a power supply and a load;

detecting means for detecting excess acid in the air around said load; and operating means for opening said switch upon actuation of said detecting means, wherein said normally closed switch is a micro switch with a lever, said micro switch is closed while said lever is biased against the resiliency of said lever and said detecting means is a wire under tension between a stationary member and a distal end portion of said lever.

4. A circuit breaker for automatically interrupting the flow of an electric current in a circuit prior to the malfunctioning of a circuit load due to acid contained in the ambient air in contact with the circuit comprising:

a normally closed switch adapted to be interposed between a power supply and a load;

detecting means for detecting excess acid in the air around said load; and operating means for opening said switch upon actuation of said detecting means, wherein said normally closed switch is a reed switch and said detecting means is comprised of a magnet movably mounted adjacent said reed switch spring means normally biasing said magnet away from said reed switch and a wire extending between a stationary member and said magnet to hold said magnet adjacent said reed switch against the force of said spring means to maintain said reed switch closed whereby upon breakage of said wire due to corrosion thereof said spring means will bias said magnet away from said reed switch to open said reed switch.

* * * * *

UNITED STATES PATENT AND TRADEMARK OFFICE

CERTIFICATE OF CORRECTION

PATENT NO. : 4,700,082

DATED : October 13, 1987

INVENTOR(S) : Tomio OGUMA et al

It is certified that error appears in the above-identified patent and that said Letters Patent is hereby corrected as shown below:

Title page, the following should be inserted:

-- [30] Foreign Application Priority Data

May 8, 1989.....[JP].....Japan.....60-096028

May 8, 1989.....[JP].....Japan.....60-096029

May 8, 1985.....[JP].....Japan.....60-096930 --.

Signed and Sealed this

Twelfth Day of September, 1989

*Attest:*

DONALD J. QUIGG

*Attesting Officer*

*Commissioner of Patents and Trademarks*